US007413381B1

(12) United States Patent
Bracone, Jr.

(10) Patent No.: US 7,413,381 B1
(45) Date of Patent: Aug. 19, 2008

(54) SEPTIC SYSTEM DRAIN FIELD

(76) Inventor: Dominic J Bracone, Jr., 1442 Roscoe Dr., Kissimmee, FL (US) 34741

( * ) Notice: Subject to any disclaimer, the term of this patent is extended or adjusted under 35 U.S.C. 154(b) by 0 days.

(21) Appl. No.: 11/620,597

(22) Filed: Jan. 5, 2007

(51) Int. Cl.
*E02B 13/00* (2006.01)

(52) U.S. Cl. ..... 405/45; 405/43

(58) Field of Classification Search ..... 405/43–49
See application file for complete search history.

(56) References Cited

U.S. PATENT DOCUMENTS

| | | | | |
|---|---|---|---|---|
| 3,645,100 | A * | 2/1972 | La Monica | 405/46 |
| 4,192,628 | A * | 3/1980 | Gorman | 405/45 |
| 4,246,305 | A | 1/1981 | Delattre | |
| 5,466,091 | A | 11/1995 | Sauerwein et al. | |
| 5,511,346 | A | 4/1996 | Kenworthy | |
| 5,516,229 | A * | 5/1996 | Atchley et al. | 405/36 |
| 5,520,481 | A | 5/1996 | Atchley | |
| 5,567,077 | A | 10/1996 | Yang | |
| 5,597,264 | A | 1/1997 | Laak | |
| 6,177,004 | B1 | 1/2001 | Bracone, Jr. | |
| 6,336,770 | B1 * | 1/2002 | Evans | 405/43 |
| 7,118,669 | B1 * | 10/2006 | Branz | 210/170.08 |
| 2004/0265061 | A1 * | 12/2004 | Chaffee | 405/43 |

* cited by examiner

*Primary Examiner*—Sunil Singh
(74) *Attorney, Agent, or Firm*—Michael I Kroll

(57) ABSTRACT

A system to improve water distribution within a septic system drain field and in turn maximizing the efficiency of the water drainage while reducing maintenance and repair costs through the employment of a plurality of substantially parallel leeching lines in communication with a septic tank that feeds effluence thereto through a first header pipe and having a second header pipe on the opposing ends to maintain the functionality of the leeching line in the event of a clog.

8 Claims, 11 Drawing Sheets

SEPTIC SYSTEM DRAIN FIELD

BACKGROUND OF THE INVENTION

1. Field of the Invention

The present invention relates generally to waste water control and, more specifically, to a septic system drainage field.

The septic system is a natural method of treatment and disposal of household wastes for those homeowners who are not part of a municipal sewage system. A septic system works by allowing waste water to separate into layers and begin the process of decomposition while being contained within the septic tank. Bacteria, which are naturally present in all septic systems, begin to digest the solids that have settled to the bottom of the tank, transforming up to 50 percent of these solids into liquids and gases.

When liquids within the tank rise to the level of the outflow pipe, they enter the drainage system. This outflow, or effluent, is then distributed throughout the drain field through a series of subsurface pipes. Final treatment of the effluence occurs here as the soil absorbs and filters the liquid and microbes break down the rest of the waste into harmless material. The drainage field in an often overlooked aspect of the septic system, yet it is more important than the tank for the proper operation of the entire system.

The present invention is a new drain field design for a septic system filter apparatus for filtering waste water as it travels from a septic tank to a septic field. Unlike septic system drain fields of prior art, the septic system drain field of the present invention does not require piping through the chambers and in turn improves the distribution of the waste water.

The drain field design comprises a header pipe leading from the septic tank to a series of chambers. A second header pipe is connected to the opposite end of the chambers. The unique chamber assembly of the present invention consists of a housing having a base forming support, top cover plate, end plate, a channel having drain apertures extending the length of said channel wall (both sides) and when necessary inner support members.

Each chamber assembly is interlocked end to end forming a desired length of the drain field and nominally spaced apart side to side forming a desired width of the drain field. The length and width of the drain field varies based on local code and project specification.

By eliminating the inner piping through the chamber typical of prior art, the septic system drain field of the present invention provides improved waste water distribution and in turn maximizes the efficiency of the drain field and reduces maintenance cost for the entire system.

2. Description of the Prior Art

There are other septic system drain field designs, but while these forms of drain field designs may be suitable for the purposes for which they were designed, they would not be as suitable for the purposes of the present invention, as hereinafter described.

SUMMARY OF THE PRESENT INVENTION

A primary object of the present invention is to provide a drain field arrangement for a septic system filter apparatus for filtering waste water as it travels from a septic tank to a septic field.

Another object of the present invention is to provide a drain field arrangement for a septic system that does not require piping through the drain field chambers.

Yet another object of the present invention is to provide a drain field arrangement for a septic system that improves the distribution of the waster water.

Still yet another object of the present invention is to provide a drain field arrangement for a septic system that comprises a header pipe leading from the septic tank to a series of chambers and a second header pipe that is connected to the opposite end of the chambers.

Yet another object of the present invention is to provide a drain field arrangement for a septic system consisting of a housing having a base forming support, top cover plate, end plate, a channel having drain apertures extending the length of said channel wall (both sides) and when necessary inner support members.

Another object of the present invention is to provide a drain field arrangement for a septic system that reduces maintenance cost.

Yet another object of the present invention is to provide a drain field arrangement for a septic system that is easy to install.

Still yet another object of the present invention is to provide a drain field arrangement for a septic system that is cost effective for the manufacturer, installer and end user.

Additional objects of the present invention will appear as the description proceeds.

The present invention overcomes the shortcomings of the prior art by providing a means to improve water distribution within a septic system drain field and in turn maximizing the efficiency of the water drainage while reducing maintenance and repair costs.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
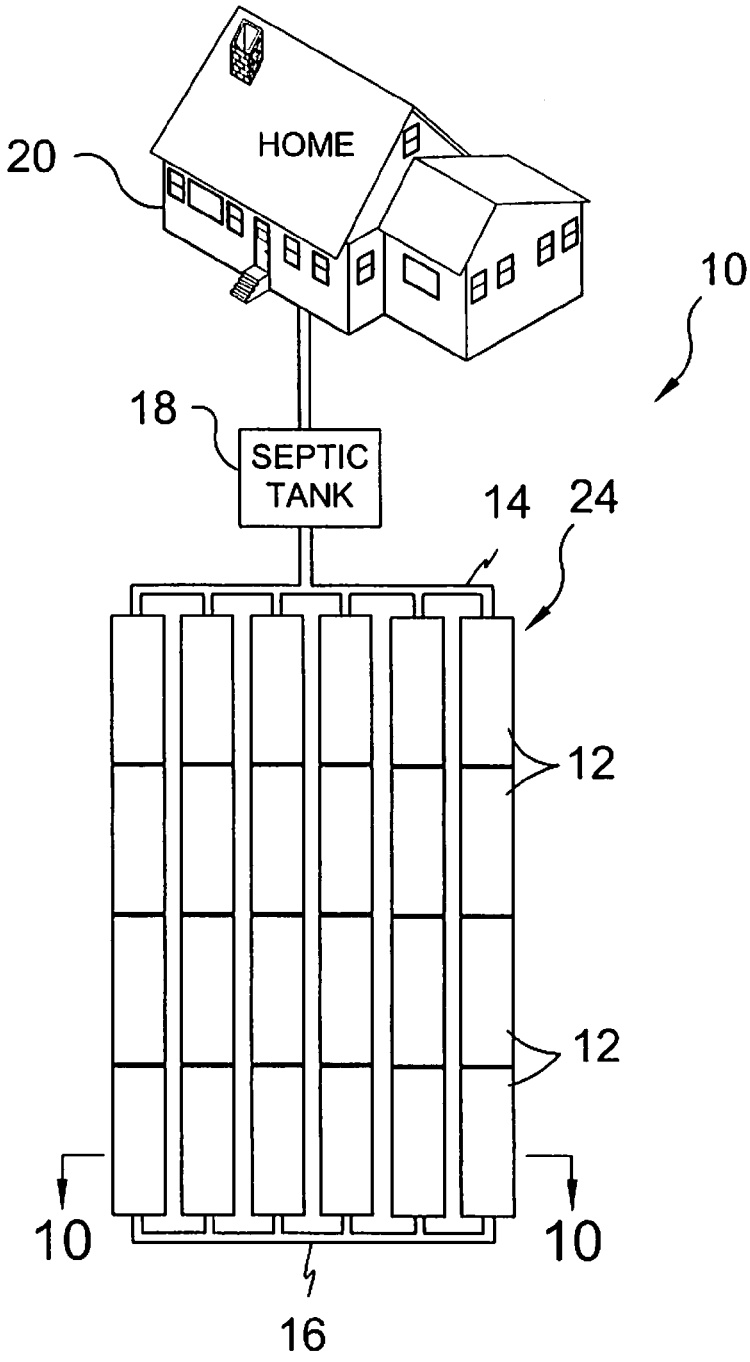
FIG. 1 is an illustrative view of the present invention in use.

Turning now descriptively to the drawings, in which similar reference characters denote similar elements throughout the several views, the figures illustrate the Septic System Drain Field of the present invention. With regard to the reference numerals used, the following numbering is used throughout the various drawing figures.

10 Septic System Drain Field of the present invention
12 dominator chamber
14 front header pipe
16 end header pipe
18 septic tank
20 dwelling
22 septic field
24 leeching line
26 housing of 12
28 base support feet of 12
30 housing walls
32 effluence channel of 26
34 top cover plate
36 end plate
38 recess of 36
40 drain holes of 32
42 slots of 30
44 inner support
46 retaining flange of 36
48 native backfill
50 top soil
52 established vegetation

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is a septic system drain field 10 apparatus for filtering waste water as it travels from a septic tank 18 to a septic field 22. The drain field 10 design comprises a plurality of interlocking dominator chambers 12 that are subterraneanaly connected in end-to-end fashion to provide extended leeching lines 24 of a desired length. A plurality of leeching lines 24 are disposed side by side in parallel relation with one another. Waste water from the dwelling 20 is introduced to a septic tank 18 then gravity fed to the septic system drain field 10 via a front header pipe 14 and delivered into the leeching lines 24 through the first dominator chamber 12 thereof. An end header pipe 16 is in communication with the last dominator chamber 12 of each leeching line thereby creating a relatively closed drain field 10 wherein waste water escapes through a plurality of drain holes disposed in the dominator chambers and will redirect effluence to other leeching lines 24 in the event that one becomes clogged.

Figure 2:
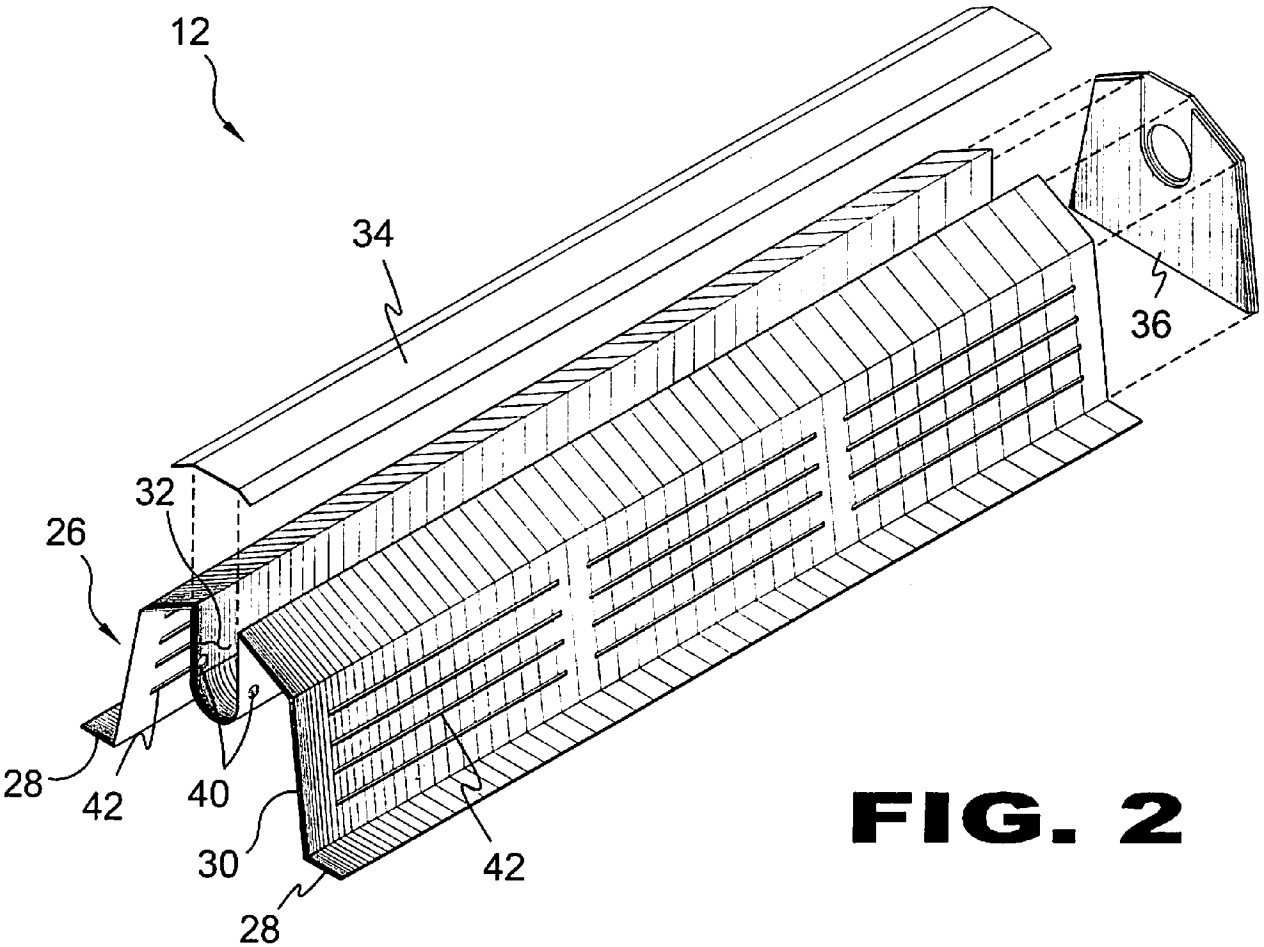
FIG. 2 is a perspective view of the present invention.

FIG. 2 is a perspective view of the dominator chamber 12 of the present invention including a housing 26 having walls 30 on either side of an effluence channel 32 and base support feet 28 disposed on the bottom ends of the walls 30. A top cover plate 34 encloses the effluence channel 32 and an end plate 36 is secured to the ends of the first and last dominator chamber 12 of each leeching line and includes a recess 38 for receiving a header pipe therein. A plurality of drain holes 40 are disposed in the effluence channel 32 for the egress of effluence therefrom and a plurality of longitudinal slots 42 are further included in the walls 30 to aid in the dispersion of the waste water into the septic field.

Figure 3:
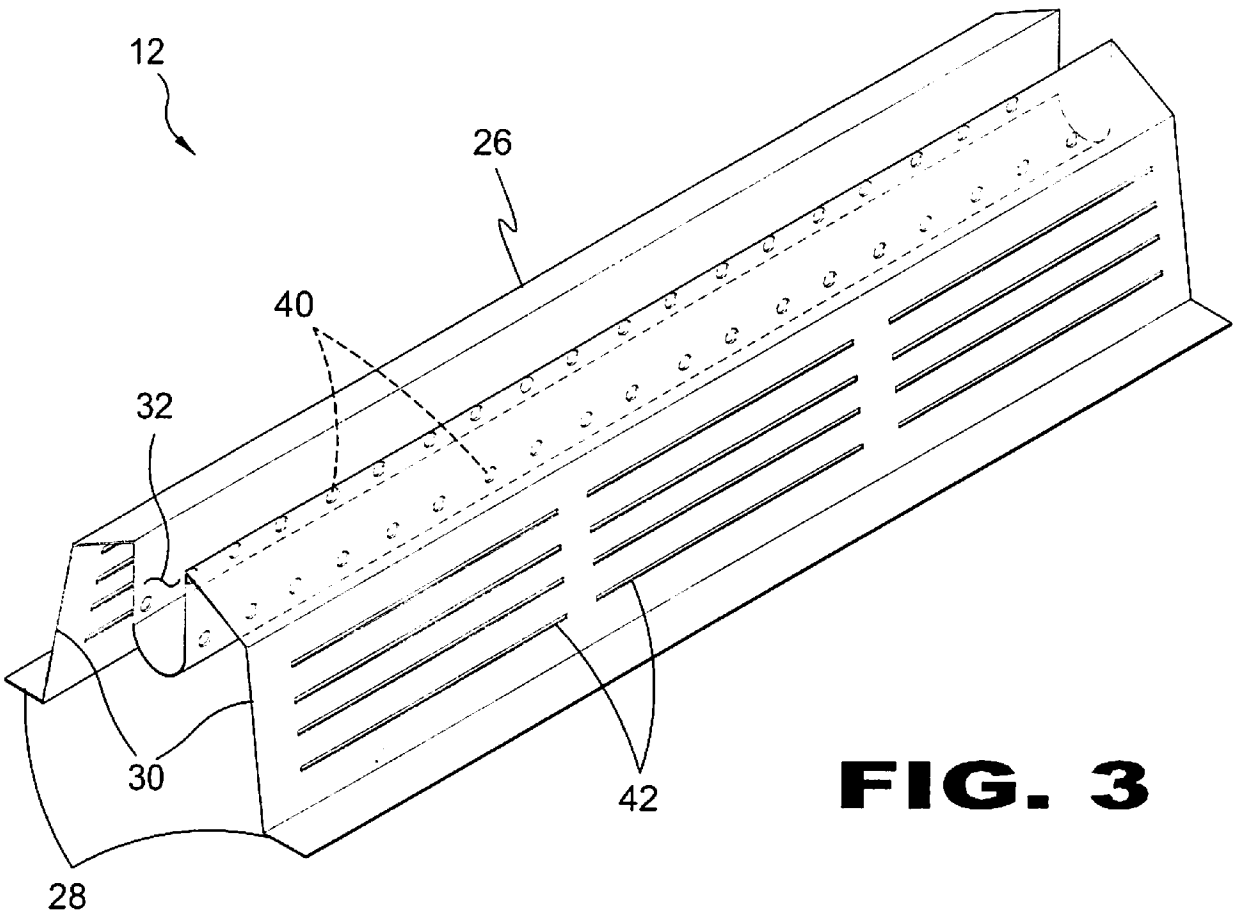
FIG. 3 is a perspective view of the present invention.

FIG. 3 is a perspective view of the dominator chamber 12 of the present invention including a housing 26 having walls 30 on either side of an effluence channel 32 and base support feet 28 disposed on the bottom ends of the walls 30. A plurality of drain holes 40 are disposed in the effluence channel 32 for the egress of effluence therefrom and a plurality of longitudinal slots 42 are further included in the walls 30 to aid in the dispersion of the waste water into the septic field.

Figure 4:
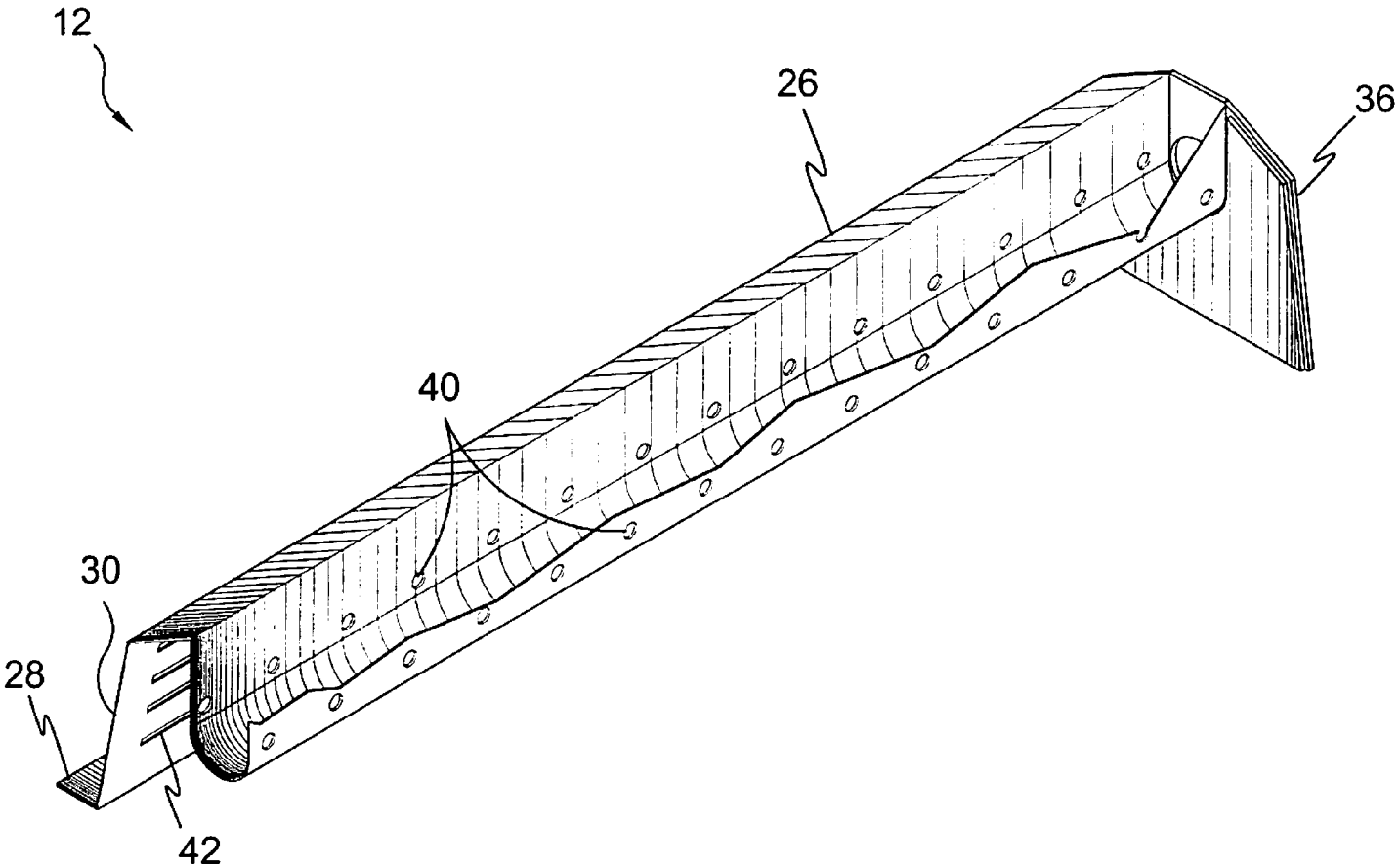
FIG. 4 is a perspective cutaway view of the present invention.

FIG. 4 is a perspective cutaway view of the dominator chamber 12 including a housing 26 having walls 30 on either side of an effluence channel 32 and base support feet 28 disposed on the bottom ends of the walls 30. A plurality of drain holes 40 are disposed in the effluence channel 32 for the egress of effluence therefrom and a plurality of longitudinal slots 42 are further included in the walls 30 to aid in the dispersion of the waste water into the septic field. The end plate 36 is secured thereto to accommodate a header pipe.

Figure 5:
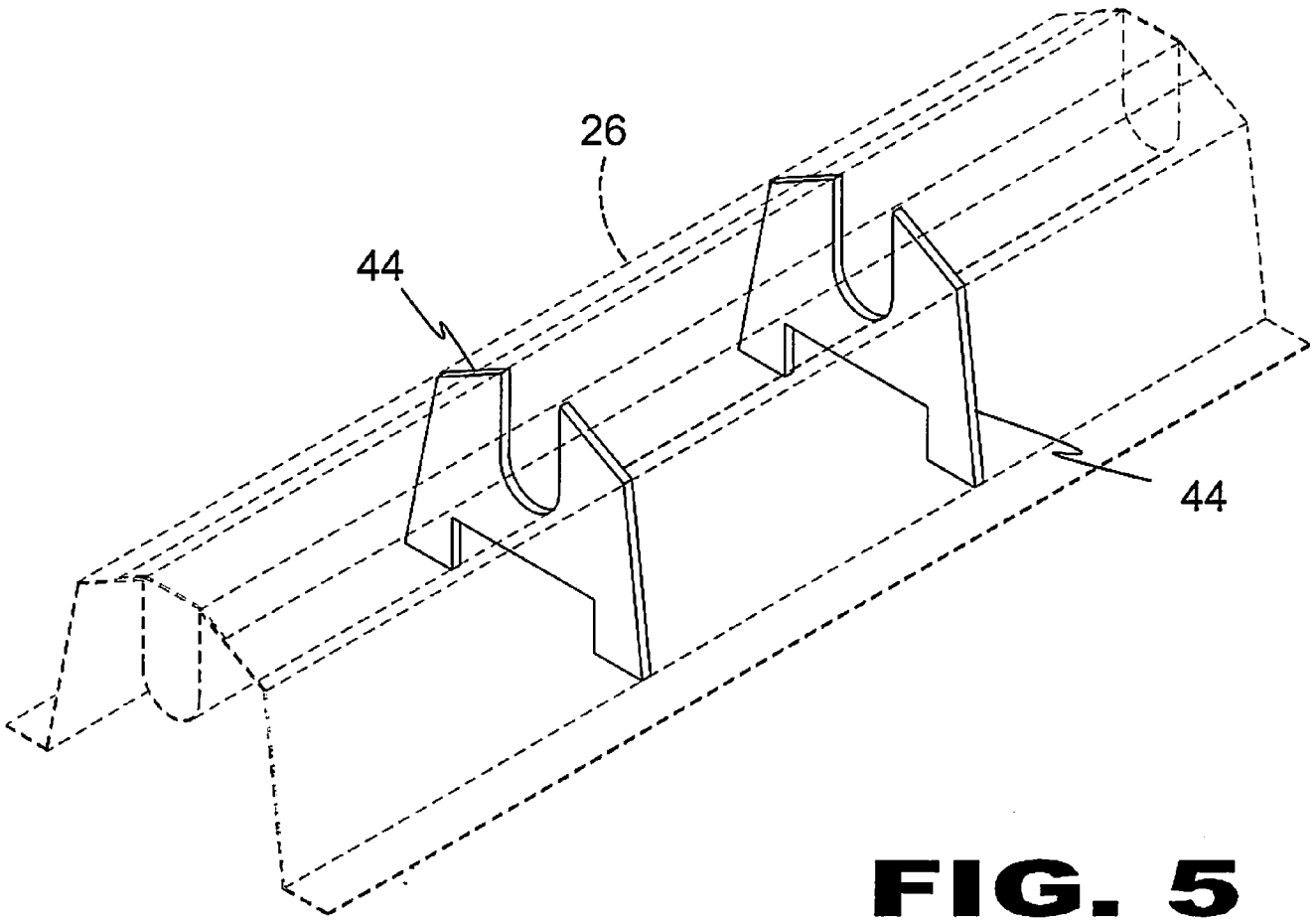
FIG. 5 is a perspective view of the optional inner supports of the present invention.

FIG. 5 is a perspective view of the optional inner supports 44 of the present invention. The present invention provides optional inner support members 44 for placement within the housing 26. The separate inner supports 44 are used as necessary, and may not be required in an application where support can be built into the chamber.

Figure 6:
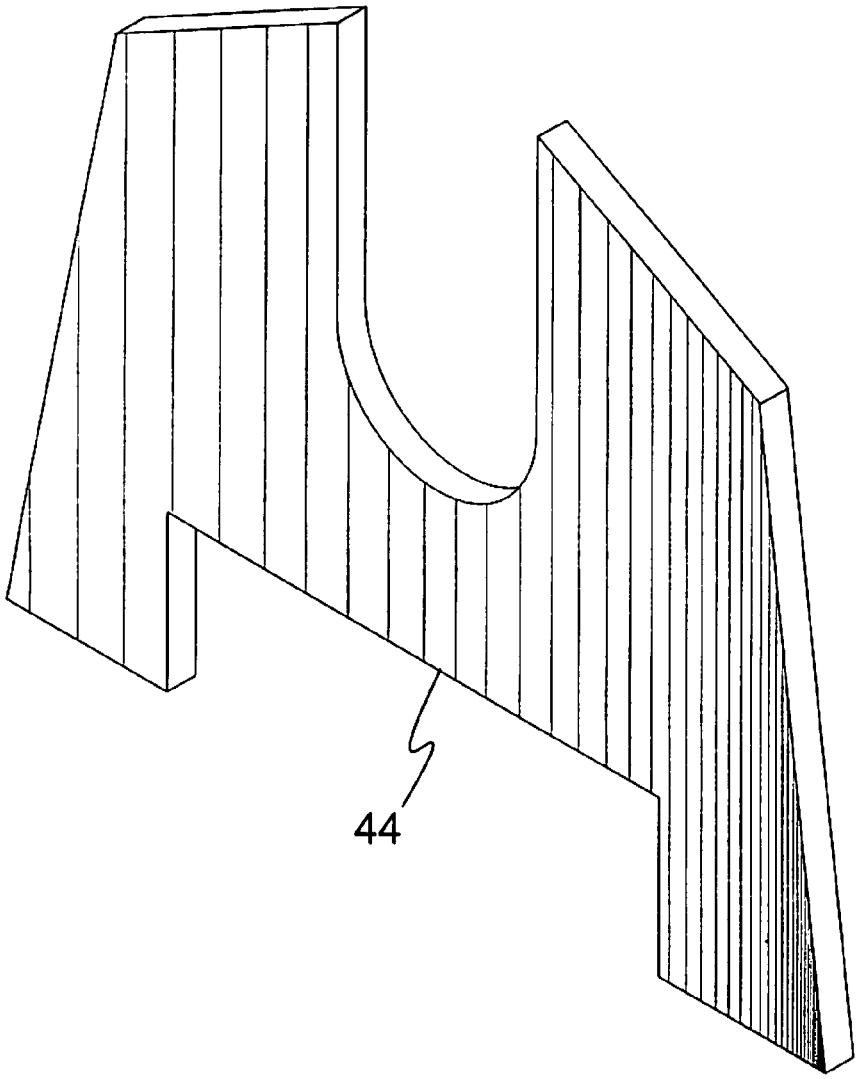
FIG. 6 is a detailed view of the optional inner support of the present invention.

FIG. 6 is a detailed view of the optional inner support 44 of the present invention. The present invention provides optional inner support members 44 for its drain field design. The drain field design comprises a housing having a base forming support, walls and top cover plate, end plate, and a channel having drain apertures extending the length of the channel wall (both sides) and each unit lockable to other units having header pipes at both ends. The optical inner support members 44 are used as necessary, and may not be required in an application where support can be built into the chamber.

Figure 7:
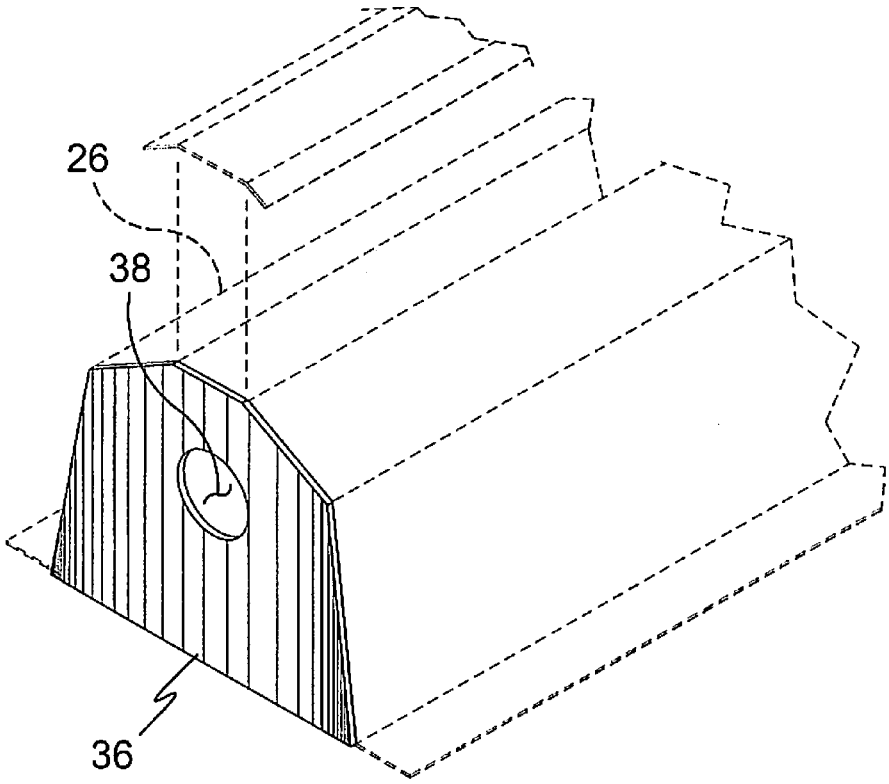
FIG. 7 is a detailed view of the end plate of the present invention.

FIG. 7 is a detailed view of the end plate 36 of the present invention. The present invention provides end plate members 36 for its drain field design. The drain field design comprises a housing 26 having a base forming support, inner pipe and top support, end plate members 36 and a channel having drain apertures extending the length of said channel wall and each unit lockable to other units having header pipes at both ends. The end plate 36 has a recess 38 to accept a header pipe therein.

Figure 8:
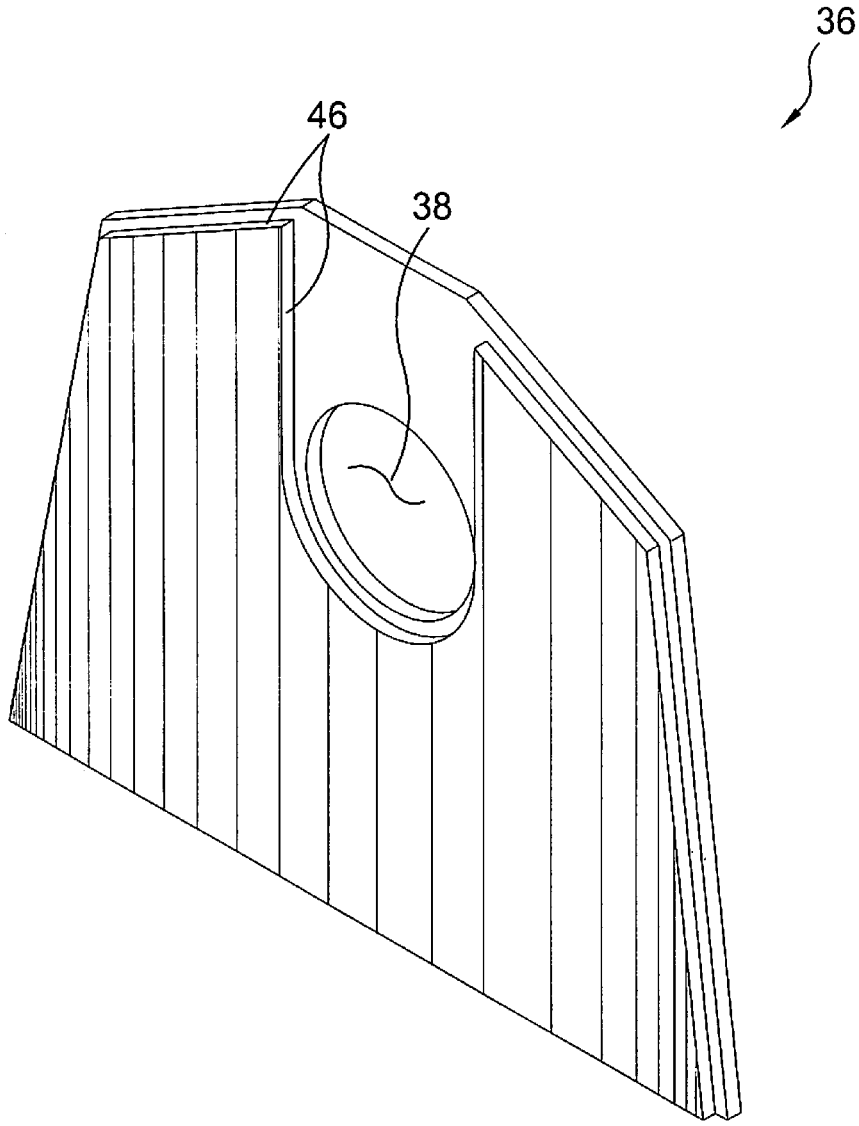
FIG. 8 is a detailed view of the end plate of the present invention.

FIG. 8 is a detailed view of the end plate 36 of the present invention. The end plate 36 is secured to the open end of each dominator chamber at the end of the leeching line. An extruded retaining flange 46 conforming to the shape of the housing of the dominator chamber is offset from the edge thereof for securing the end plate 36 to the chamber. A recess 38 is provided for connection to a header pipe and the passage of effluence therethrough.

Figure 9:
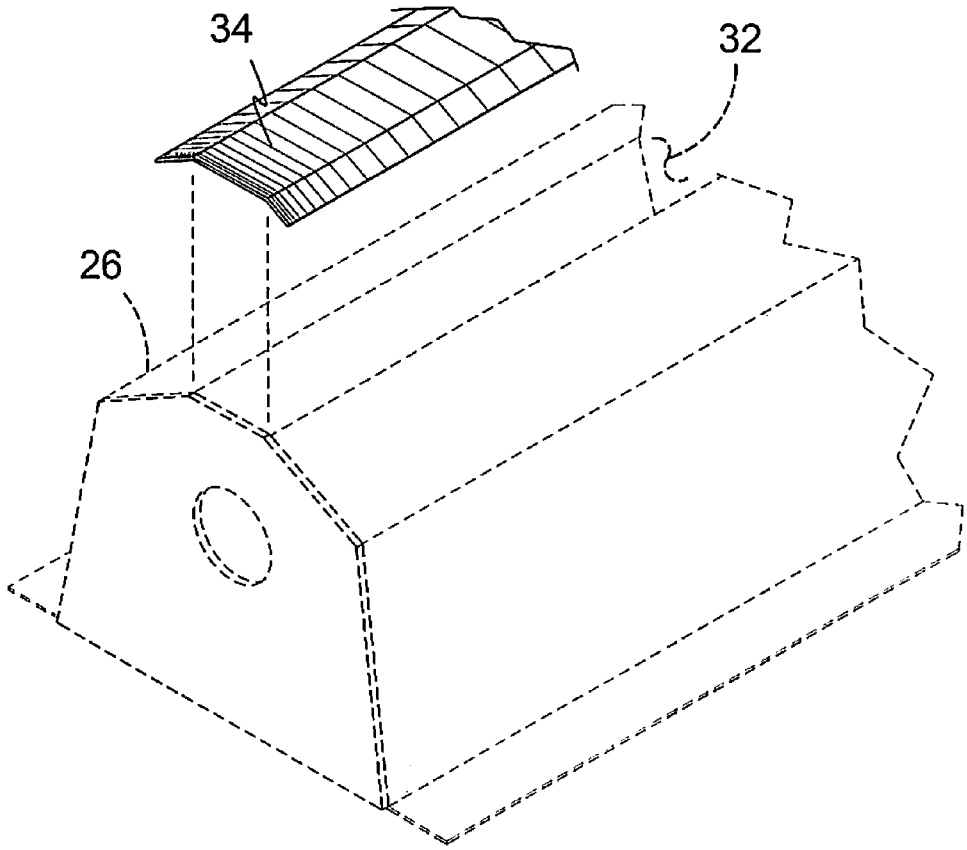
FIG. 9 is a detailed view of the cover plate of the present invention.

FIG. 9 is a detailed view of the cover plate of the present invention. The present invention provides a top cover plate member 34 for its drain field design. The cover plate 34 resides on the housing 26 to enclose the effluence channel 32.

Figure 10:
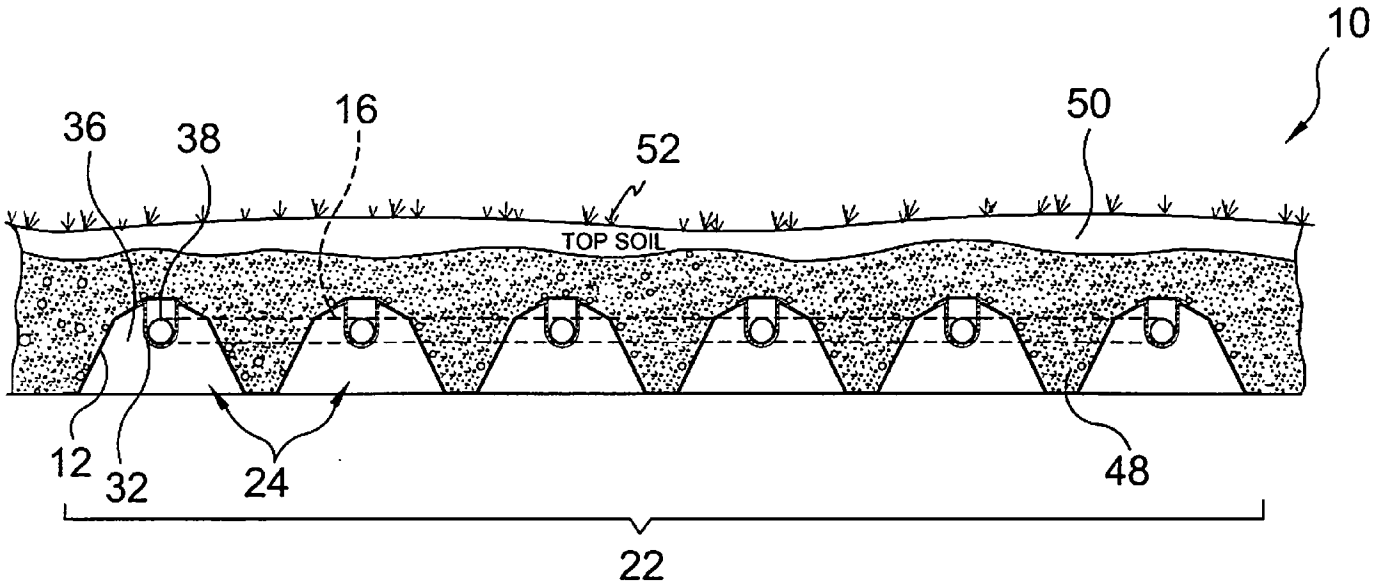
FIG. 10 is a sectional view of the present invention in use.

FIG. 10 is a sectional view of the present invention 10 in use taken from FIG. 1 as indicated. Shown are six parallel leeching lines 24, each comprising a plurality of interlocking dominator chambers 12 attached end-to end with end plates 36 disposed on the ends of each leeching line 24. Recesses 38 in the end plate 36 are in communication with header pipes (end header pipe 16 is shown) and the respective effluence channel 32 to allow for the passage of effluence therethrough. Once installed, the septic system drain field 10 is covered by native backfill 48, top soil 50 and established vegetative cover 52. The effluence leeches into the septic field 22 through a plurality of recesses disposed in each effluence channel 32 where it continues the process of decomposition. The advantage of having header pipes on both ends of each leeching line 24 is to provide an alternate point of entry for effluence in the event of a clog thereby enabling the leeching line 24 to remain functional even if compromised.

Figure 11:
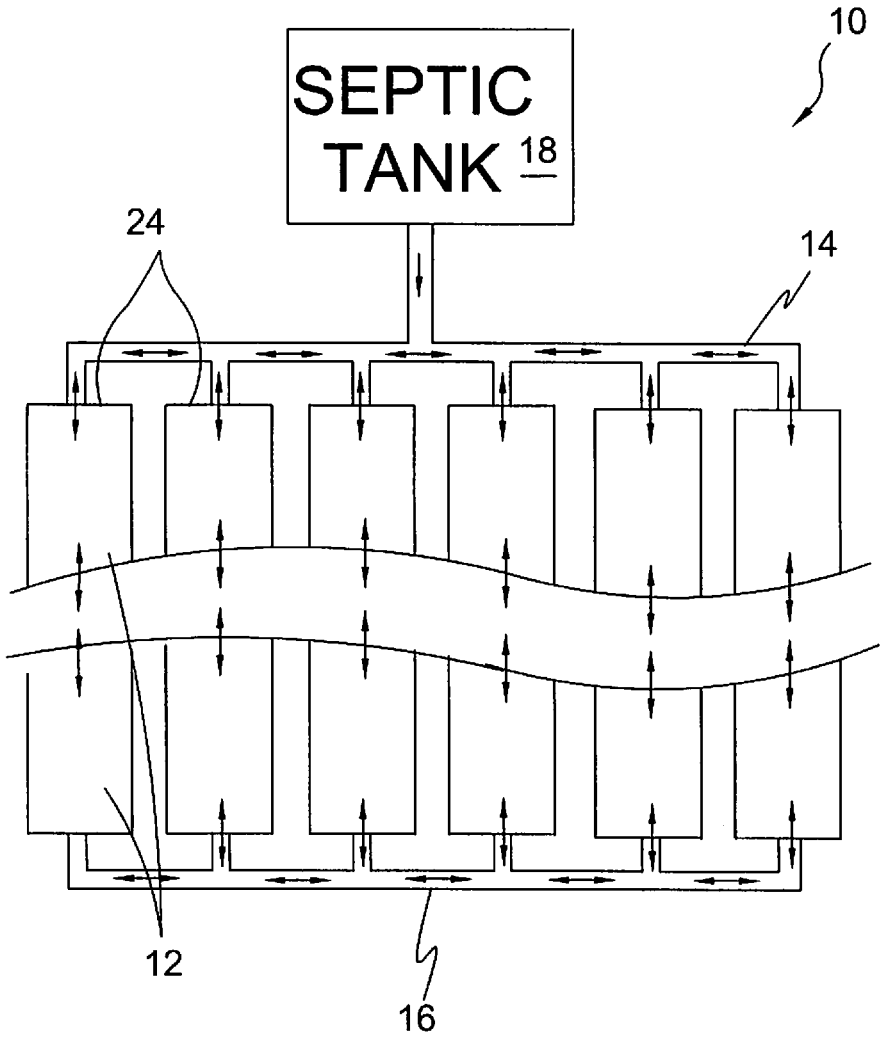
FIG. 11 is an illustrative view of the present invention in use.

FIG. 11 is an illustrative view of the present invention 10. Shown are six parallel leeching lines 24, each comprising a plurality of interlocking dominator chambers 12 attached end-to end. The arrows indicate possible flow of effluence within the system from the septic tank 18. The advantage to having header pipes 14,16 on both ends of each leeching line 24 is to provide an alternate point of entry for effluence in the event of a clog thereby enabling the leeching line 24 to remain functional even if compromised.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A septic system drain field for receiving effluence from a septic tank and to provide for controlled leeching therefrom into a septic field for further decomposition thereof, said septic system drain field comprising:

a) a plurality of leeching lines having a first end and a second end;

b) a header pipe in communication with said septic tank and the first end of each said leeching line;

c) a closed header pipe in communication with the second end of each said leeching line to provide a secondary means for effluence to enter a leeching line thereby enabling said drain field to remain functional in the event of a clog that would otherwise compromise the ability of the leeching line to function effectively;

d) each leeching line comprising at least one dominator chamber;

e) each dominator chamber comprising an elongate plate fabricated to form a pair of opposing walls, a top section joining said opposing walls, an effluence channel formed in said top section, said effluence channel having a bottom and sides with a top opening, said opposing walls having sloping portions away from said top opening of said effluence channel, and a top cover plate covering the top opening of said effluence channel, said top cover plate having sloping edge portions for engaging said sloping portions of said opposing walls to effectively prevent said effluence from overflowing therefrom;

f) said sides of said effluence channel having drain holes;

g) the opposing walls of said dominator chamber having extended slots; and h) each dominator chamber having an end plate at each end thereof with an access opening for a header pipe.

2. The septic system drain field recited in claim 1, wherein each said leeching line comprises a plurality of dominator chambers.

3. The septic system drain field recited in claim 2, wherein said dominator chambers interlock with one another in end-to-end fashion.

4. The septic system drain field recited in claim 3, wherein said end plate includes a retaining flange sized to sit flush againt an interior profile of said effluence channel while the portion of said end plate extending therebeyond resides against the end of said dominator chamber.

5. The septic system drain field recited in claim 4, wherein said slots are disposed in a plurality of spaced apart columns in said dominator chamber walls.

6. The septic system drain field recited in claim 5, wherein said dominator chamber further include at least one inner support member shaped to conform substantially with the interior profile of said dominator chamber for use when the integrity therefor may be compromised.

7. The septic system drain field recited in claim 6, wherein the walls of said dominator chamber other include substantially horizontal feet on the bottom ends thereof.

8. A septic system drain field for receiving effluence from a septic tank and to provide for controlled leeching therefrom into a septic field for further decomposition thereof, said septic system drain field comprising:

a) a plurality of leeching lines having a first end and a second end;

b) a header pipe in communication with said septic tank and the first end of each said leeching line;

c) a closed header pipe in communication with the second end of each said leeching line;

d) each leeching line comprising at least one dominator chamber;

e) each dominator chamber comprising an elongate plate fabricated to form a pair of opposing walls, a top section joining said opposing walls, an effluence channel formed in said top section, said effluence channel having a bottom and sides with a top opening, said opposing walls having sloping portions away from said top opening of said effluence channel, and a top cover plate covering the top opening of said effluence channel to effectively prevent said effluence from overflowing therefrom, said top cover plate having sloping edge portions for engaging said sloping portions of said opposing walls;

f) bottom edges of said opposing walls having horizontal, outwardly extending base support feet;

g) said sides of said effluence channel having drain holes;

h) the opposing walls of said dominator chamber having extended slots for drainage;

i) each dominator chamber having an end plate at each end thereof with an access opening for a header pipe; and j) each end plate having a retaining flange sized to sit flush against an interior profile of said effluence channel, the outer wall of each end plate having said access opening.

* * * * *